US008246033B2

(12) United States Patent
Sato

(10) Patent No.: US 8,246,033 B2
(45) Date of Patent: Aug. 21, 2012

(54) IMAGE FORMING SYSTEM AND SHEET HANDLING APPARATUS

(75) Inventor: Ryuichi Sato, Kanagawa (JP)

(73) Assignee: Fuji Xerox Co., Ltd., Kanagawa (JP)

( * ) Notice: Subject to any disclaimer, the term of this patent is extended or adjusted under 35 U.S.C. 154(b) by 117 days.

(21) Appl. No.: 12/910,537

(22) Filed: Oct. 22, 2010

(65) Prior Publication Data

US 2011/0222945 A1 Sep. 15, 2011

(30) Foreign Application Priority Data

Mar. 10, 2010 (JP) ..... 2010-052769

(51) Int. Cl.
*B65H 37/04* (2006.01)

(52) U.S. Cl. ..... 270/58.09; 270/58.07; 270/58.08; 399/407; 399/410

(58) Field of Classification Search ..... 270/37, 270/52.18, 58.07, 58.08, 58.09, 58.11; 399/408, 399/410

See application file for complete search history.

(56) References Cited

U.S. PATENT DOCUMENTS

| | | | | |
|---|---|---|---|---|
| 5,508,798 | A * | 4/1996 | Yamada | 399/410 |
| 5,722,031 | A * | 2/1998 | Fujii et al. | 399/410 |
| 5,899,841 | A * | 5/1999 | Berger | 493/351 |
| 6,088,568 | A * | 7/2000 | Ohtani | 399/408 |
| 6,091,929 | A * | 7/2000 | Yamazaki et al. | 399/410 |
| 7,424,237 | B2 * | 9/2008 | Ushio et al. | 399/82 |
| 8,011,650 | B2 * | 9/2011 | Tao et al. | 270/58.09 |

FOREIGN PATENT DOCUMENTS

| | | |
|---|---|---|
| JP | 2000-318918 | 11/2000 |
| JP | 3885410 A | 12/2006 |

* cited by examiner

*Primary Examiner* — Leslie A Nicholson III
(74) *Attorney, Agent, or Firm* — Sughrue Mion, PLLC

(57) ABSTRACT

An image forming system includes an image forming unit that forms images on sheets; a sheet compiling unit that compiles the sheets on which the image forming unit has formed the images into a sheet stack; a first binding unit that binds a first end portion of the sheet stack by performing a first binding process; a second binding unit that binds a second end portion of the sheet stack by performing a second binding process, the second end portion being different from the first end portion; and an image rotation unit that rotates an orientation of each of the images in accordance with whether the sheet stack is to be bound by using the first binding unit or the second binding unit, the images being formed on the sheets of the sheet stack by the image forming unit.

10 Claims, 13 Drawing Sheets

IMAGE FORMING SYSTEM AND SHEET HANDLING APPARATUS

CROSS-REFERENCE TO RELATED APPLICATIONS

This application is based on and claims priority under 35 USC 119 from Japanese Patent Application No. 2010-052769 filed Mar. 10, 2010.

BACKGROUND (i) Technical Field

The present invention relates to an image forming system and a sheet handling apparatus.

(ii) Related Art

In general, an image forming apparatus, such as a printer, includes a post-processing device either as standard equipment or as optional equipment. The post-processing device performs post-processing on a printed sheet upon request from a user.

SUMMARY

According to an aspect of the invention, an image forming system includes an image forming unit that forms images on sheets; a sheet compiling unit that compiles the sheets on which the image forming unit has formed the images into a sheet stack; a first binding unit that binds a first end portion of the sheet stack by performing a first binding process, the sheet stack having been compiled by the sheet compiling unit; a second binding unit that binds a second end portion of the sheet stack by performing a second binding process, the sheet stack having been compiled by the sheet compiling unit, the second end portion being different from the first end portion; and an image rotation unit that rotates an orientation of each of the images in accordance with whether the sheet stack is to be bound by using the first binding unit or the second binding unit, the images being formed on the sheets of the sheet stack by the image forming unit.

BRIEF DESCRIPTION OF THE DRAWINGS

Exemplary embodiments of the present invention will be described in detail based on the following figures, wherein.

DETAILED DESCRIPTION

Hereinafter, exemplary embodiments of the invention will be described in detail with reference to the attached drawings.

First Exemplary Embodiment

Figure 1:
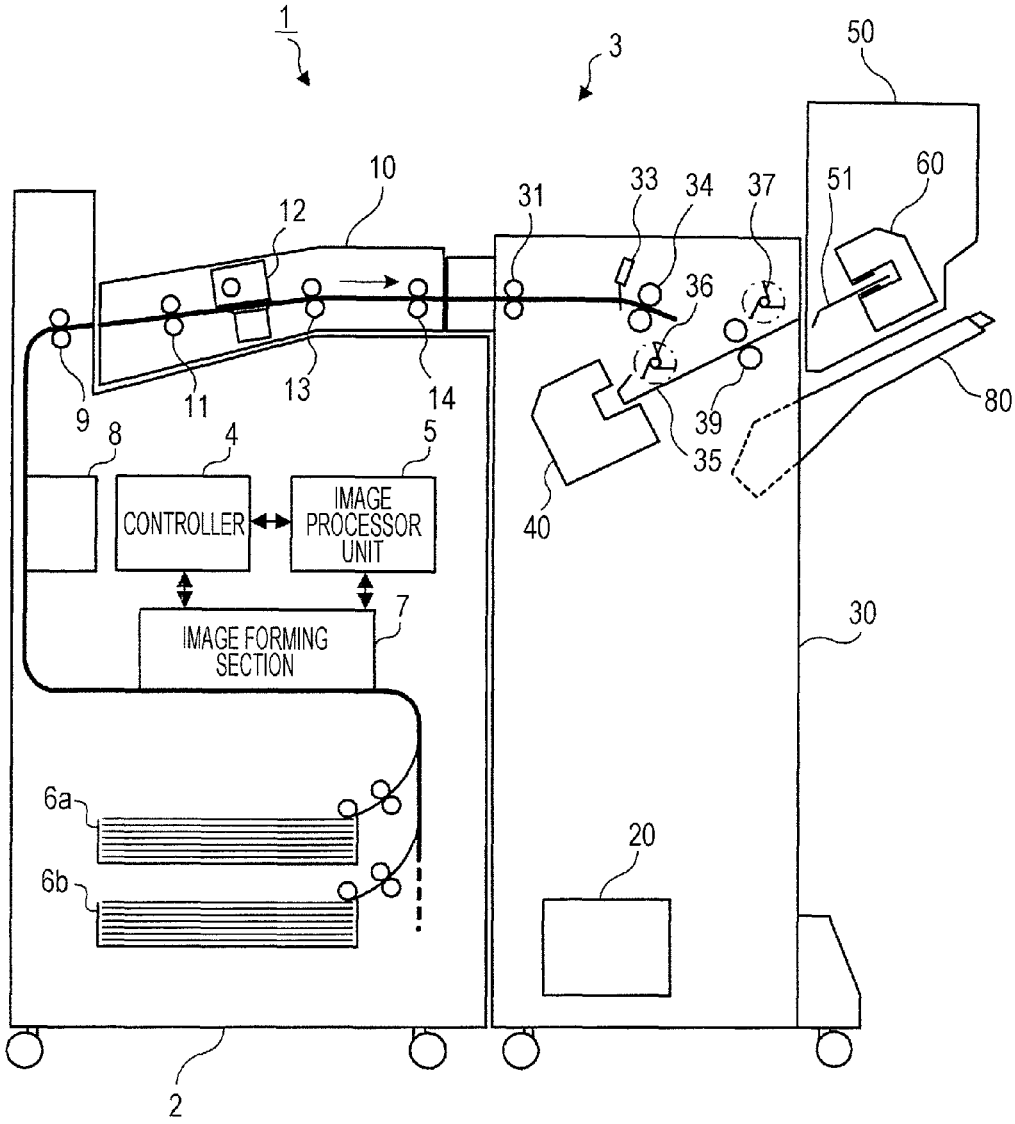
FIG. 1 illustrates the overall structure of an image forming system according to an exemplary embodiment of the invention.

FIG. 1 illustrates the overall structure of an image forming system according to a first exemplary embodiment. Referring to FIG. 1, an image forming system 1 includes an image forming apparatus 2, such as a printer or a copier, and a sheet handling apparatus 3. The image forming apparatus 2 forms a color image by using, for example, an electrophotographic method. The sheet handling apparatus 3 performs a post-processing on a sheet on which a toner image or the like is formed by the image forming apparatus 2.

The image forming apparatus 2 includes a controller 4, an image processor 5, sheet feeders 6*a* and 6*b*, an image forming section 7, a fixing section 8, and output rollers 9. The controller 4 controls the overall operation of the image forming apparatus 2. The image processor 5 performs image processing on image data. The sheet feeders 6*a* and 6*b* (hereinafter, collectively referred to as a "sheet feeder 6") feeds a sheet. The image forming section 7 forms a toner image on the sheet supplied by the sheet feeder 6. The fixing section 8 fixes the toner image that has been formed on the sheet by the image forming section 7. The output rollers 9 output the sheet on which an image has been formed.

The controller 4 includes a central processing unit (CPU), a read only memory (ROM), a random access memory (RAM), and the like. The controller 4 executes various application programs and calculation, thereby controlling various sections of the image forming apparatus 2. The image processor 5 performs image processing on image data that is read by an image reader (not shown) or image data that is sent from an image reading apparatus, such as a personal computer (PC) or a scanner, on the basis of various input commands, such as the selection of an image forming mode or a post-processing mode by a user, which is received through an operation unit (not shown). According to the first exemplary embodiment, the image processor 5 performs a process of rotating an image, which is formed by the image forming section 7, in accordance with a post-processing mode that is selected by a user (as described below). The image processor 5 is an example of an image rotation unit, and the image forming section 7 is an example of an image forming unit.

The sheet feeder 6 includes sheet cassettes that contain various types of sheets, feed rollers that feed a sheet from the sheet cassettes, transport rollers that transport the sheet. The sheet feeder 6 supplies the sheet to the image forming section 7 when image forming is performed. According to the first exemplary embodiment, the sheet feeder 6 includes, for example, the sheet feeder 6*a* that feeds a so-called A4 short-edge feed (SEF) sheets and a sheet feeder 6*b* that feeds a so-called A4 long-edge feed (LEF) sheets.

The image forming section 7 forms a toner image on the sheet supplied by the sheet feeder 6 on the basis of image data on which image processing has been performed by the image processor 5. The fixing section 8 includes a fixing unit that includes a roller, which includes a heat source, and a pressing member. By making the sheet to pass through a nip between the roller and the pressing member, the toner image is heated, pressed against, and fixed on the sheet. The output rollers 9 output the sheet, on which the fixing section 8 has fixed the toner image, to a transport unit 10 of the sheet handling apparatus 3.

The sheet handling apparatus 3 includes the transport unit 10, a first post-processing device 30, and a second post-processing device 50. The transport unit 10 transports the sheet, which has been output by the image forming apparatus 2, further downstream. The first post-processing device 30 includes, for example, a compile tray 35 that forms a stack of sheets and a stapler 40 that binds the sheet stack using a staple. The second post-processing device 50, which is disposed downstream of the first post-processing device 30, includes a stapleless binding unit 60 that binds the sheet stack without using a staple. The sheet handling apparatus 3 includes a controller 20 that controls the sheet handling apparatus 3. The controller 20 is disposed, for example, in the first post-processing device 30.

As illustrated in FIG. 1, the transport unit 10 of the sheet handling apparatus 3 includes a pair of entrance rollers 11 and a puncher 12. The entrance rollers receive the sheet, which is output from the output rollers 9 of the image forming apparatus 2. The puncher 12 punches the sheet, which is received by the entrance rollers 11. The transport unit 10 includes a pair of first transport rollers 13 and a pair of second transport rollers 14, which are disposed downstream of the puncher 12. The first transport rollers 13 transport the sheet downstream, and the second transport rollers 14 transport the sheet toward the first post-processing device 30.

The first post-processing device 30 of the sheet handling apparatus 3 includes a pair of receiving rollers 31, an exit sensor 33, a pair of exit rollers 34, and the compile tray 35. The receiving rollers 31 receive the sheet from the transport unit 10. The exit sensor 33, which is disposed downstream of the receiving rollers 31, detects the sheet. The exit rollers 34 output the sheet to the compile tray 35. The compile tray 35, which is an example of a sheet compiling unit, compiles plural sheets into a sheet stack. The first post-processing device 30 further includes a main paddle 36 and a sub-paddle 37. These paddles rotate so as to push a trailing end of the sheet toward an end guide 35*b* (see FIG. 2) of the compile tray 35. The first post-processing device 30 further includes a tamper 38 (see FIG. 2) and an eject roller 39. The tamper 38 adjusts the positions of ends of the sheet (in a direction perpendicular to the direction in which the sheet is transported) by pushing the sheet toward a side guide 35*c* (see FIG. 3) of the compile tray 35. The eject roller 39, which is an example of a transport unit, transports the sheet stack stacked by the compile tray 35 downstream toward the second post-processing device 50. The first post-processing device 30 further includes the stapler 40 and a stacker tray 80. The stapler 40, which is an example of a first binding unit, binds an end portion of the sheet stack, which is disposed on the compile tray 35, by performing a binding process using a staple (first binding process). The stacker tray 80, which is an example of a sheet stack tray, piles up sheet stacks that have been post-processed.

The second post-processing device 50 of the sheet handling apparatus 3 includes the stapleless binding unit 60 and a sheet stack supporter 51. The stapleless binding unit 60, which is an example of a second binding unit, binds an end portion of the sheet stack, which is being transported, by performing a binding process without using a staple (second binding process). The sheet stack supporter 51, which is an example of a support unit, supports the sheet stack during the second binding process. (Hereinafter, the second binding process will be referred to as a "stapleless binding process".) The stacker tray 80 is disposed below the stapleless binding unit 60. The sheet stack, on which one of the binding processes has been performed by the stapler 40 or the stapleless binding unit 60, is sequentially piled up on the stacker tray 80. The sheet stack supporter 51 is located on the sheet transport path during the stapleless binding process and retracted from the sheet transport path when the stapleless binding process has been finished and the sheet stack has been output.

Figure 2:
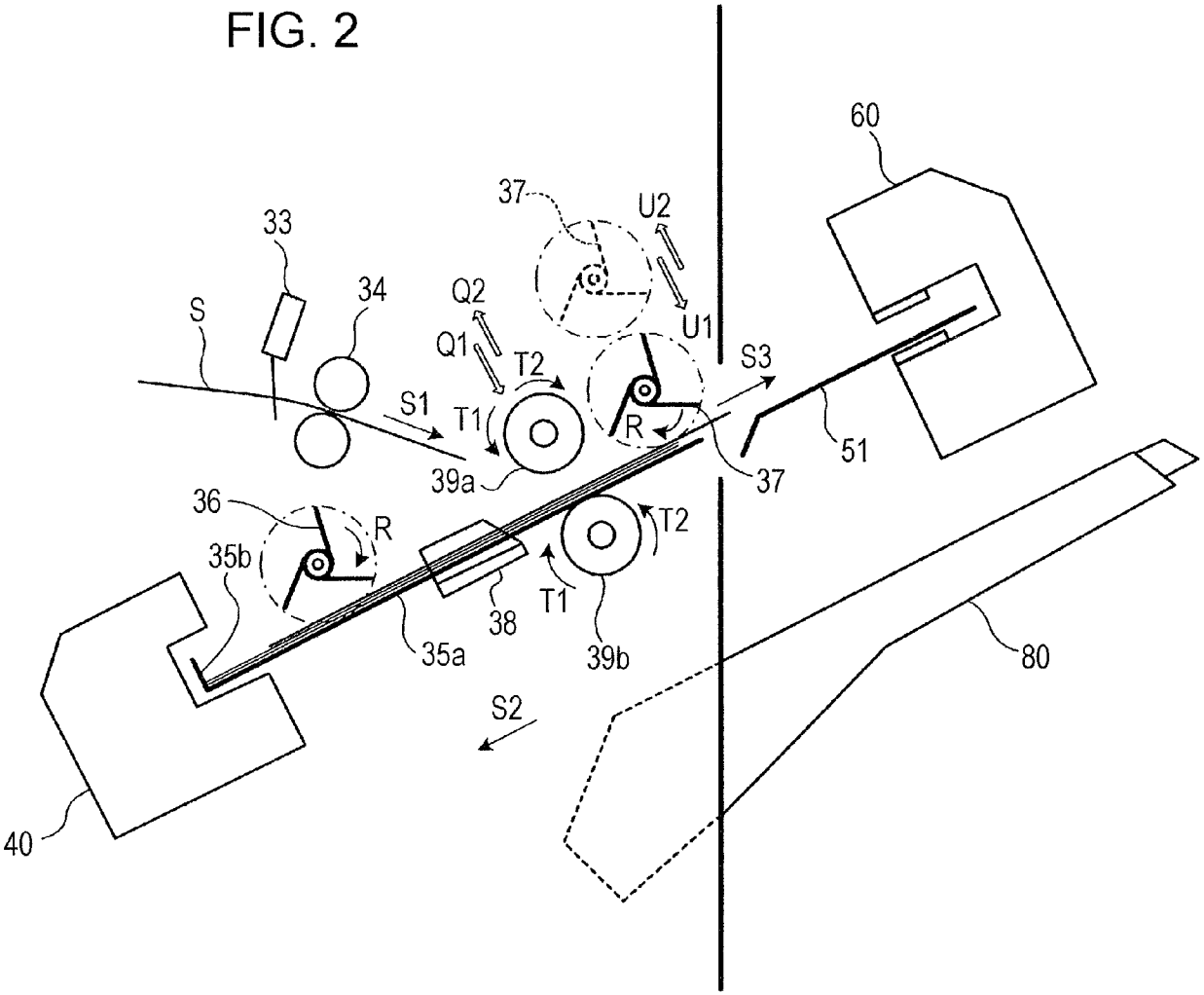
FIG. 2 is a detailed view of a region surrounding a compile tray of a first post-processing device.

FIG. 2 is a detailed view of a region surrounding the compile tray 35 of the first post-processing device 30. The compile tray 35, which has been described referring to FIG. 1, includes a bottom portion 35*a*, the end guide 35*b*, and the side guide 35*c* (see FIG. 3). The bottom portion 35*a* has an upper surface on which a sheet S is stacked. The end guide 35*b*, which has a surface extending from the bottom portion 35*a* in a direction substantially perpendicular to the bottom portion 35*a*, aligns an end portion of the sheet S in the transport direction (direction S2 in FIG. 2) when compiling a sheet stack. The side guide 35*c* aligns an end portion of the sheet S extending in a direction perpendicular to the transport direction. If the compile tray 35 is made from, for example, a metal plate, the end guide 35*b* may be made by bending the bottom surface of the compile tray 35.

In the direction perpendicular to the direction S2 of the compile tray 35, a lateral direction alignment unit that aligns the sheet S in the direction perpendicular to the direction S2 (lateral direction of the sheet S) is disposed. The lateral direction alignment unit includes the side guide 35*c* and the tamper 38. The side guide 35*c* is disposed on a proximal side of the apparatus in FIG. 2. The tamper 38, which is disposed on a distal side of the apparatus in FIG. 2, moves from the distal side toward the proximal side so as to press the sheet S against the side guide 35*c*. In the lateral direction alignment unit, a driving motor (not shown) rotates so as to provide a driving force to the tamper 38 at a timing at which the sheet is transported to the compile tray 35. When the motor rotates, the tamper 38 moves from a stand-by position corresponding to a sheet size, thereby moving from the distal side toward the proximal side in FIG. 2. The lateral sides of the sheet S, which is transported to the compile tray 35, are aligned by this movement of the tamper 38.

The sub-paddle 37 moves in the direction U1 in FIG. 2 to contact the sheet S. The sub-paddle 37 moves in the direction U2 in FIG. 2 to be separated from the sheet S. The main paddle 36 and the sub-paddle 37 rotate in the direction R in FIG. 2 while being in contact with the sheet S, thereby pushing the sheet S, which has been transported in the direction S1 in FIG. 2, in the direction S2 on the compile tray 35.

As illustrated in FIG. 2, the eject roller 39 includes a first eject roller 39*a* and a second eject roller 39*b*. When compiling the sheet stack, the first eject roller 39*a* has been moved upward (in the direction Q2), and the first eject roller 39*a* is separated from the second eject roller 39*b*. When the sheet stack is transported toward the second post-processing device 50 (in the direction S3 in FIG. 2), the first eject roller 39*a* moves downward (in the direction Q1) so as to contact the sheet stack. The eject roller 39 rotates in the direction T1 in FIG. 2 while being in contact with the sheet stack, and transports the sheet stack downstream toward the second post-processing device 50. Moreover, the eject roller 39 have a registration function (described below) whereby the eject roller 39 adjusts the position of the sheet stack by performing, for example, stop/transport control of the sheet S when transporting the sheet stack to the stapleless binding unit 60. Hereinafter, the term "sheet transport direction" refers to the direction S3 in FIG. 2.

Figure 3:
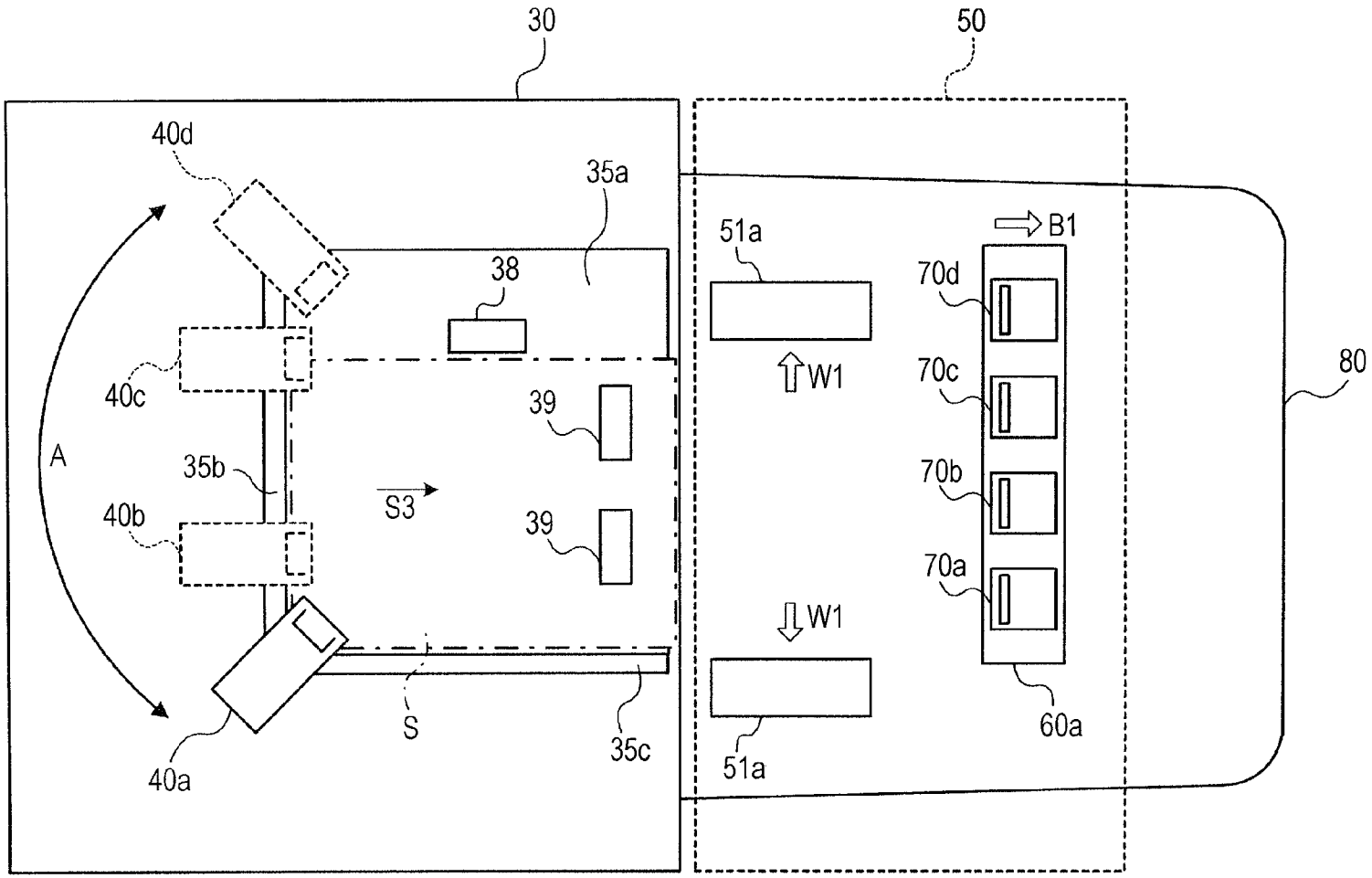
FIG. 3 is a top view of the first post-processing device and a second post-processing device according to a first exemplary embodiment, viewed from a direction substantially perpendicular to a surface of a sheet that is being transported.
Figure 4:
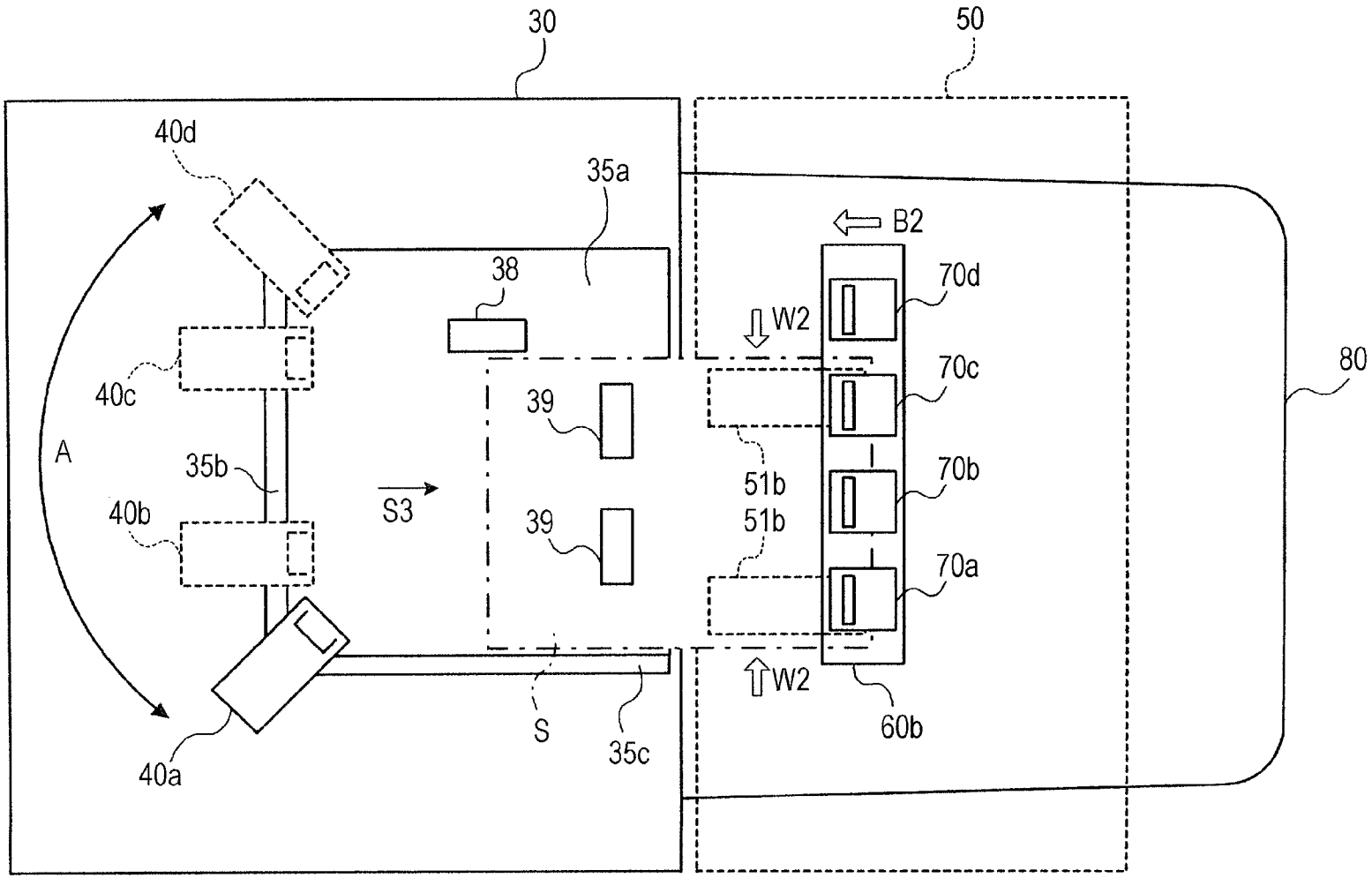
FIG. 4 is a top view similar to FIG. 3, illustrating a state in which the second post-processing device is performing a stapleless binding process.

FIG. 3 is a top view of the first post-processing device 30 and the second post-processing device 50 according to the first exemplary embodiment, viewed from a direction substantially perpendicular to a surface of the sheet S that is being transported. FIG. 4 is a top view similar to FIG. 3, illustrating a state in which the second post-processing device 50 is performing the stapleless binding process. For simplicity, some members such as the main paddle 36 are not illustrated in FIGS. 3 and 4.

The stapler 40 of the first post-processing device 30 pushes a staple into the sheet stack, thereby binding an end portion (first end portion) of the sheet stack, which has been aligned by the compile tray 35, the end portion being at the upstream end in the direction S3. The stapler 40 is configured to be movable along a rail (not shown), and is driven by a stapler moving motor (not shown). The rail is formed in the periphery of the compile tray 35 so as to extend in the longitudinal direction (vertically in FIG. 3) of the end guide 35*b* (see arrow A of FIG. 3). The sheet stack may be stapled at any positions in the end portions or the corners of the sheet stack (see positions 40*a* to 40*d* in FIG. 3).

When performing a one-position binding process on the sheet stack placed on the compile tray 35, the stapler 40 remains in the home position (for example, the position 40*a* in FIG. 3) and successively performs the one-position binding process at necessary timings. When performing a two-position binding process on the sheet stack, the stapler 40 is moved by the stapler moving motor to a predetermined binding position after a certain number of the sheets S have been stacked on the compile tray 35, and performs the two-position binding process. The movement of the stapler 40 is controlled by the controller 20.

The sheet stack supporter 51 of the second post-processing device 50 supports the sheet stack when the stapleless binding unit 60 performs the stapleless binding process. The sheet stack supporter 51 has a surface that contacts the lowermost surface of the sheet stack that is being transported. The sheet stack supporter 51 is configured to be movable in directions (directions W1 and W2 in FIGS. 3 and 4) that are substantially perpendicular to the sheet transport direction. When the stapleless binding unit 60 does not perform the stapleless binding process, the sheet stack supporter 51 is located in the home position (a position 51*a* in FIG. 3), which is outside the sheet transport path (that is, outside the end portions of the sheet stack that are parallel to the sheet transport direction of the sheet stack). When the stapleless binding unit 60 performs the stapleless binding process, the sheet stack supporter 51 moves from the home position to the stapleless binding position (a position 51*b* in FIG. 4) on the sheet transport path. In the home position, the sheet stack supporter 51 supports the sheet stack.

The sheet stack supporter 51 may be moved by using a mechanism including a driving motor (not shown), a gear (not shown) that transfers the rotation of the driving motor to the sheet stack supporter 51, and a spur gear (not shown) that converts the rotation transferred by the gear to a driving force in a direction substantially perpendicular to the sheet transport direction. Alternatively, the sheet stack supporter 51 may be moved by using a mechanism that moves the sheet stack supporter 51 in a direction substantially perpendicular to the sheet transport direction by using a solenoid and a spring attached to the shaft of the solenoid. However, the mechanism for moving the sheet stack supporter 51 is not limited to these examples. If a driving motor or a solenoid is used to move the sheet stack supporter 51, the operation of the driving motor or the solenoid may be controlled by the controller 20 (see FIG. 1).

The stapleless binding unit 60 of the second post-processing device 50 includes four stapleless binding mechanisms each of which performs a binding process on a downstream end portion (second end portion) of the sheet stack that has been transported. In contrast to the stapler 40, the stapleless binding unit 60, which is configured to bind an end portion of the sheet stack without using a staple, does not require supply of staples. The stapleless binding unit 60 includes a base (not shown) and a rail (not shown). The base supports the stapleless binding unit 60, and the rail provides a path along which the stapleless binding unit 60 moves. The rail extends in a direction substantially parallel to the sheet transport direction. The stapleless binding unit 60 is movable along the rail in directions B1 and B2 in FIGS. 3 and 4. The stapleless binding unit 60 is moved by a move motor (not shown) on the basis of the detection result obtained by a position sensor (not shown), which detects the position of the stapleless binding unit 60. In addition to the directions B1 and B2, the stapleless binding unit 60 may be moved in a direction perpendicular to the directions B1 and B2 (a direction that intersects the sheet transport direction).

When the stapleless binding unit 60 does not perform the stapleless binding process, the stapleless binding unit 60 is located a home position 60*a* illustrated in FIG. 3, where the stapleless binding unit 60 does not obstruct the path of the sheet stack that is output to the stacker tray 80. When the stapleless binding unit 60 performs the stapleless binding process on the sheet stack that has been transported, the stapleless binding unit 60 moves in the direction B2 and stops at the binding process position 60*b* in FIG. 4, and successively performs the stapleless binding process at necessary timings. The movement of the stapleless binding unit 60 and the stapleless binding process are controlled by the controller 20.

Figure 5A:
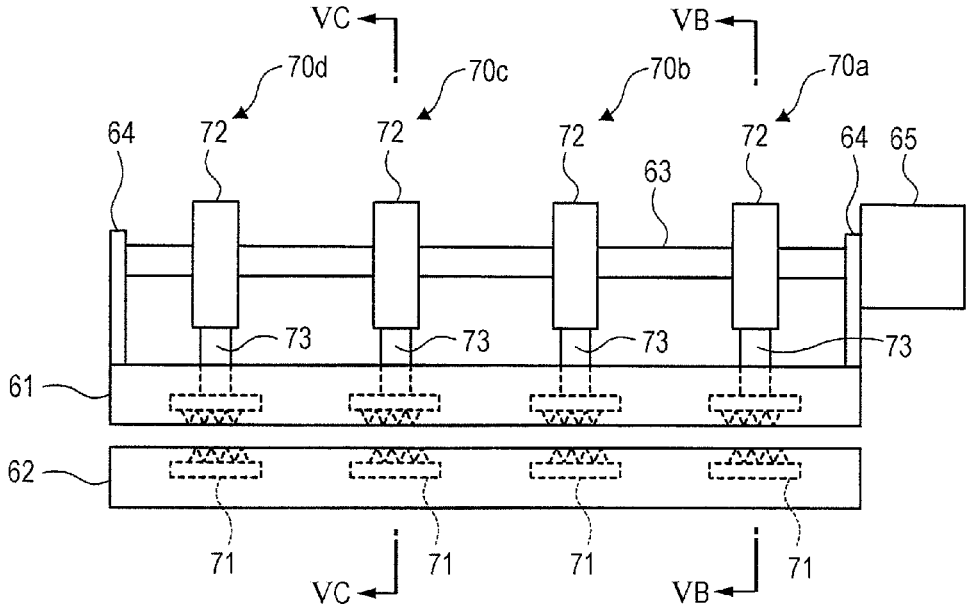
FIGS. 5A to 5C illustrate the structure of a stapleless binding unit.
Figure 5B:
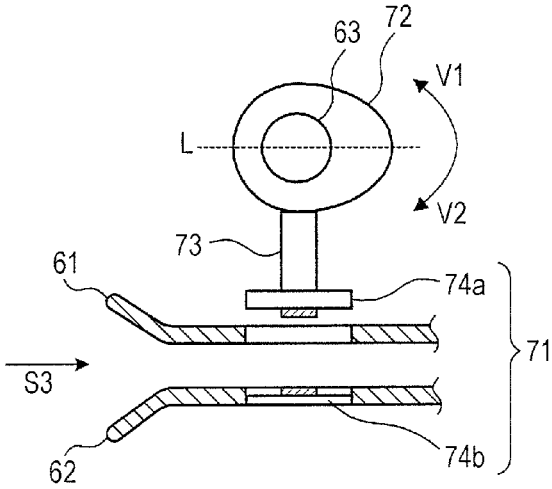
Figure 5C:
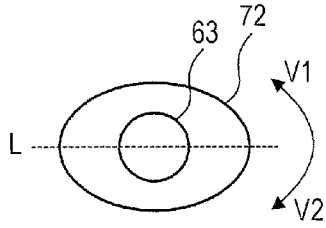

FIGS. 5A to 5C illustrate the structure of the stapleless binding unit 60. FIG. 5A illustrates the stapleless binding unit 60 viewed from the image forming apparatus 2. FIG. 5B is a sectional view taken along line VB-VB of FIG. 5A. FIG. 5C is a sectional view of a cam 72 taken along line VC-VC of FIG. 5A. As illustrated in FIG. 5A, the stapleless binding unit 60 includes four stapleless binding mechanisms 70 (70*a*, 70*b*, 70*c* and 70*d*) for binding the sheet stack. Each of the stapleless binding mechanisms 70 includes a binding section 71, the cam 72 that drives the binding section 71, and a spring 73 that presses an upper end portion of the binding section 71 against the cam 72. The four stapleless binding mechanisms 70 are arranged with regular intervals therebetween in a direction substantially perpendicular to the sheet transport direction. The stapleless binding unit 60 includes an upper chute 61 and a lower chute 62, between which the sheet stack is inserted (in the direction S3 in FIG. 5B). The stapleless binding unit 60 further includes a cam shaft 63 to which the cam 72 is attached, a supporting member 64 that supports the cam shaft 63, and a driving motor 65 that rotates the cam shaft 63.

As illustrated in FIG. 5B, the binding section 71 includes an upper pressing portion 74*a* and a lower pressing portion 74*b*, which will be described in detail below. The upper pressing portion 74*a* of the binding section 71 moves up and down and pass through the upper chute 61. The stapleless binding process is performed by pressing the upper pressing portion 74*a* against the lower pressing portion 74*b* with the sheet stack therebetween when the sheet stack is inserted between the upper chute 61 and the lower chute 62 in the direction S3.

The cams 72 of the four stapleless binding mechanisms 70 have a substantially elliptical shape, and are attached to the common cam shaft 63. The cam shaft 63 is rotatably supported by the supporting member 64, which is disposed on the upper chute 61. The cam shaft 63 is rotated by the driving motor 65, which is disposed at one end of the cam shaft 63.

According to the first exemplary embodiment, for example, as illustrated in FIG. 5B, the cams 72 of the stapleless binding mechanisms 70*a*, 70*b*, and 70*d* are configured so that the binding sections 71 are driven once when the cam shaft 63 rotates once. As illustrated in FIG. 5C, the cam 72 of the stapleless binding mechanism 70*c* is configured so that the binding section 71 is driven twice when the cam shaft 63 rotates once. Moreover, the cams 72 of the stapleless binding mechanisms 70*a* to 70*d* are attached to the cam shaft 63 so that the long axes thereof (indicated by broken line L in FIGS. 5B and 5C) are parallel to each other. Thus, for example, when the cam shaft 63 is rotated in the direction V1 in FIGS. 5B and 5C by a predetermined angle, the stapleless binding mechanism 70*c* binds the sheet stack at one position. When the cam shaft 63 is rotated in the direction V2 in FIGS. 5B and 5C by a predetermined angle, the four stapleless binding mechanisms 70*a* to 70*d* bind the sheet stack at plural positions. The rotation of the cam shaft 63 is controlled by the controller 20. As described above, according to the first exemplary embodiment, the sheet stack may be bound at different positions by changing the rotation direction of the cam shaft 63.

Figure 6A:
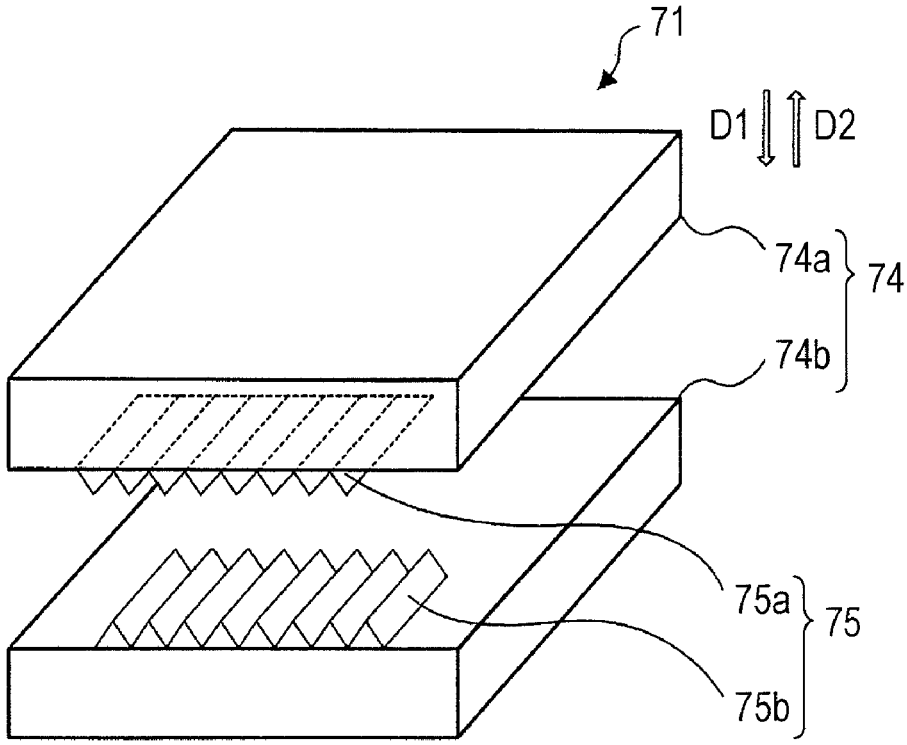
FIGS. 6A and 6B illustrate a binding section of a stapleless binding mechanism.
Figure 6B:
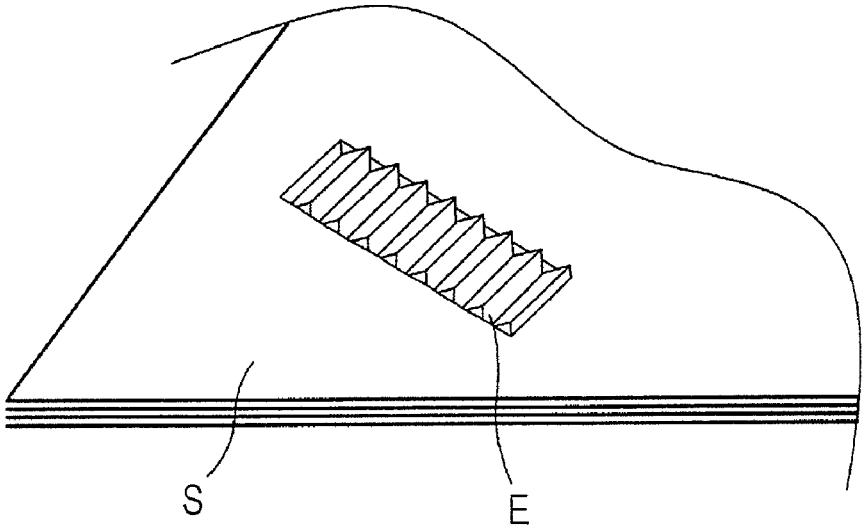

FIGS. 6A and 6B illustrate the binding section 71 of one of the stapleless binding mechanisms 70. FIG. 6A is a schematic perspective view of the binding section 71. FIG. 6B illustrates a corner of a sheet stack that has been bound by the stapleless binding mechanism 70. The binding section 71 includes a pressing portion 74 and an embossing portion 75. When the pressing portion 74 is pressed toward the embossing portion 75, the pressing portion 74 applies a pressure to an end portion of the sheets S, and the embossing portion 75 embosses the sheet S so as to bind the sheet stack by the pressure applied by the pressing portion 74.

The pressing portion 74 includes the upper pressing portion 74*a* and the lower pressing portion 74*b*. As described with reference to FIGS. 5A to 5C, the upper pressing portion 74*a* is moved back and forth with respect to the lower pressing portion 74*b* (see arrows D1 and D2 of FIG. 6A) by rotating the cam 72 with the driving motor 65. The upper pressing portion 74*a* and the lower pressing portion 74*b* apply a pressure to the sheet stack that is inserted therebetween.

The embossing portion 75 includes a protruding portion 75*a* and a receiving portion 75*b*. The protruding portion 75*a* is included in the upper pressing portion 74*a*, and the receiving portion 75*b* is included in the lower pressing portion 74*b*. The protruding portion 75*a* and the receiving portion 75*b* emboss the sheet stack that is inserted therebetween. To be specific, protrusions and recesses are formed in a surface of the protruding portion 75*a*, the surface being opposite the receiving portion 75*b*. Protrusions and recesses are formed in a surface of the receiving portion 75*b*, the surface being opposite the protruding portion 75*a*. The surface of the protruding portion 75*a* in which the protrusions and recesses are formed is substantially parallel to the surface of the receiving portion 75*b* in which the protrusions and recesses are formed. The protruding portion 75*a* and the receiving portion 75*b* are disposed so that the protrusions of the protruding portion 75*a* mesh with the recesses of the receiving portion 75*b*. When the pressing portion 74 applies a pressure, the protruding portion 75*a* meshes with the receiving portion 75*b* to emboss the sheet stack. As illustrated in FIG. 6B, the embossed part of the sheet S, which corresponds to the shapes of the protruding portion 75*a* and the receiving portion 75*b*, is an example of protrusions and recesses that extend in a stacking direction of the sheets S. The deformed part is an embossed mark E for binding the sheet stack without using a staple.

Next, the operation of the image forming system 1 having the structure described above will be described. First, when a user operates the operation section or the like and selects a binding process using the stapler 40 as the post-processing mode, the controller 20 of the sheet handling apparatus 3, upon receiving the selection, commands the stapler 40 to perform the binding process, and moves the stapleless binding unit 60 to the home position, where the stapleless binding unit 60 then stands by. The controller 4 of the image forming apparatus 2 commands the image forming section 7 to perform the image forming process.

Thus, after a toner image has been formed on the sheet S by the image forming section 7 and the toner image has been fixed by the fixing section 8, the sheet S is supplied to the sheet handling apparatus 3 through the output rollers 9 of the image forming apparatus 2. In the transport unit 10 of the sheet handling apparatus 3, the entrance rollers 11 receive the sheet S under the control of the controller 20. Subsequently, the sheet S is transported along the sheet transport path by the first transport rollers 13 and the second transport rollers 14 downstream toward the first post-processing device 30.

In the first post-processing device 30, the sheet S, which has been received by the receiving rollers 31, is detected by the exit sensor 33 as illustrated in FIG. 2 and transported in the direction S1 by the exit rollers 34. The sheet S, which has been transported in the direction S1, is transported toward the compile tray 35 through a space between the first eject roller 39*a* and the main paddle 36. The sheet S, which has reached the compile tray 35, is pushed in the direction S2 by the rotation of the sub-paddle 37 in the direction R in FIG. 2, the sub-paddle 37 moving downward (in the direction U1 in FIG. 2), and by the rotation of the main paddle 36 in the direction R in FIG. 2. The trailing end of the sheet S is pressed against the end guide 35*b* and aligned. When the sheet S is received by the compile tray 35 and reaches the end guide 35*b*, the tamper 38 moves from the distal side toward the proximal side of the device in FIG. 2 in a direction substantially perpendicular to the direction S2, and the positions of the sides of the sheets S to be accumulated are adjusted one by one.

Subsequently, when a predetermined number of the sheets S have been accumulated on the compile tray 35, the compile tray 35 compiles the sheets S into a sheet stack. The stapler 40 is moved in accordance with the binding position, and the stapler 40 performs the binding process. Subsequently, the first eject roller 39*a* moves downward (direction Q1 in FIG. 2), and the first eject roller 39*a* and the second eject roller 39*b* rotate in the direction T1 in FIG. 2, and the sheet stack is output to the stacker tray 80.

When a user operates the operation section or the like and selects a binding process using the stapleless binding unit 60 as the post-processing mode, the controller 20 of the sheet handling apparatus 3, upon receiving the selection, commands the stapleless binding unit 60 to perform the stapleless binding process, and moves the sheet stack supporter 51 and the stapleless binding unit 60 to the binding process positions described above. The controller 4 of the image forming apparatus 2 commands the image forming section 7 to perform the image forming process. The stapler 40 and the stapleless binding unit 60 are configured to bind end portions of the sheet stack that are opposite each other. Therefore, when the stapleless binding process is selected, the image forming section 7 forms an image that is rotated by 180 degrees as compared with the case where the stapler 40 is selected (as will be described below).

After a toner image has been formed on the sheet S by the image forming section 7 and the toner image has been fixed by the fixing section 8, the sheet S is supplied to the sheet handling apparatus 3 one by one through the output rollers 9 of the image forming apparatus 2. In the sheet handling apparatus 3, after the sheet stack has been compiled on the compile tray 35 as described above, the first eject roller 39*a* moves downward (direction Q1 in FIG. 2). The first eject roller 39*a* and the second eject roller 39*b* rotate in the direction T1 in FIG. 2, so that the sheet stack is transported downstream in the direction S3 in FIG. 2 toward the stapleless binding unit 60.

When the stapleless binding process starts, the sheet stack supporter 51 moves from the home position in the second post-processing device 50 (the position 51*a* in FIG. 3) in the direction W2 to the binding process position (the position 51*b* in FIG. 4), where the sheet stack supporter 51 then stands by. The stapleless binding unit 60 moves in the direction B2 from the home position (the position 60*a* in FIG. 3) to the binding process position (a position 60*b* in FIG. 4), where the stapleless binding unit 60 then stands by. The eject roller 39 transports the sheet stack toward the second post-processing device 50. As described above, the eject roller 39 has a registration function of adjusting the position of the sheet stack by performing the stop/transport control of the sheet stack. Therefore, the sheet stack is transported to a predetermined position (for example, as illustrated in FIG. 4, to a position at which the sheet stack has been output by about half the length of the sheet stack in the sheet transport direction), and the sheet stack is inserted into the stapleless binding unit 60.

Then, the sheet stack is stopped at a predetermined position, and the stapleless binding mechanisms 70 perform the stapleless binding process. If, for example, one-position binding is selected as the process post-processing mode, the cam shaft 63 of the stapleless binding unit 60 rotates in the direction V1 in FIGS. 5B and 5C and the stapleless binding mechanism 70*c* performs the one-position binding process as described above. If plural-position binding is selected as the process post-processing mode, the cam shaft 63 of the stapleless binding unit 60 rotates in the direction V2 in FIGS. 5B and 5C and the four stapleless binding mechanisms 70*a* to 70*d* perform the plural-position binding process as described above.

Subsequently, the sheet stack supporter 51 moves from the position 51*b* in FIG. 4 to the position 51*a* in FIG. 3, and the stapleless binding unit 60 retracts from the sheet transport path by moving from the position 60*b* in FIG. 4 to the position 60*a* in FIG. 3 in the direction B1. The first eject roller 39*a* and the second eject roller 39*b* rotate in the direction T1 in FIG. 2. Thus, the sheet stack, on which the stapleless binding process has been performed, is dropped onto the stacker tray 80 and stacked.

Figure 7A:
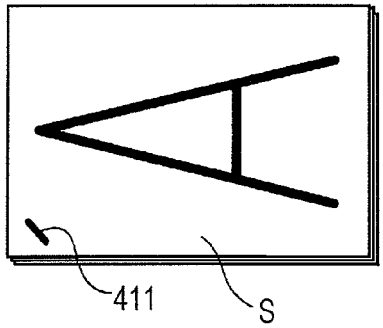
FIGS. 7A to 7D illustrate the relationship between a binding position of a sheet stack and the orientation of an image formed on a sheet according to the first exemplary embodiment.
Figure 7B:
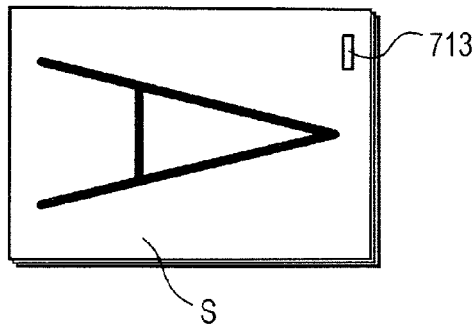

Next, a process of rotating an image to be formed on the sheet S will be described. The process is performed when the stapleless binding process is selected in the first exemplary embodiment. FIGS. 7A to 7D illustrate the relationship between the binding positions of the sheet stack in the first exemplary embodiment and the orientation of an image formed on the sheet S. FIG. 7A illustrates a state in which a corner of a sheet stack of, for example, A4 short-edge feed sheets is bound by the stapler 40 with one staple 411. When binding one corner of the sheet stack by performing the stapleless binding process in a similar manner, an embossed mark 713 is formed in an end portion of the sheet S that is opposite the end portion bound with the staple 411, because the end portion of the sheet stack bound by the stapler 40 and the end portion of the sheet stack bound by the stapleless binding unit 60 are opposite each other. Therefore, as illustrated in FIG. 7B, it is necessary to form an image on the sheet S so that the image is rotated by 180 degrees as compared with the case where the stapler 40 performs the binding process.

Figure 7C:
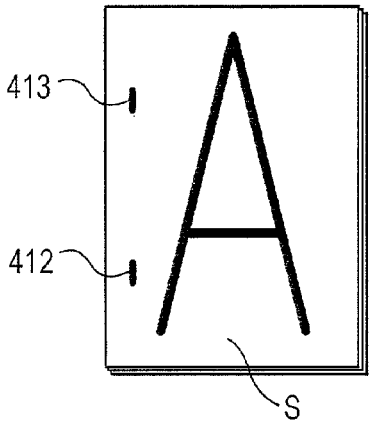
Figure 7D:
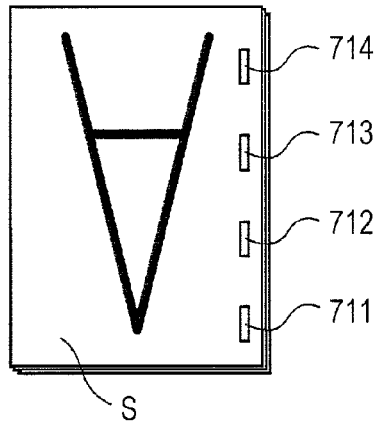

FIG. 7C illustrates a state in which an end portion of a sheet stack of, for example, A4 long-edge feed sheets is bound by the stapler 40 with two staples 412 and 413. When binding plural positions in an end portion of the sheet stack by performing the stapleless binding process, embossed marks 711 to 714 are formed in an end portion that is opposite the end portion that is bound with the staples 412 and 413. Therefore, as illustrated in FIG. 7D, it is necessary to form an image on the sheet S so that the image is rotated by 180 degrees as compared with the case where the stapler 40 performs the binding process.

Figure 8:
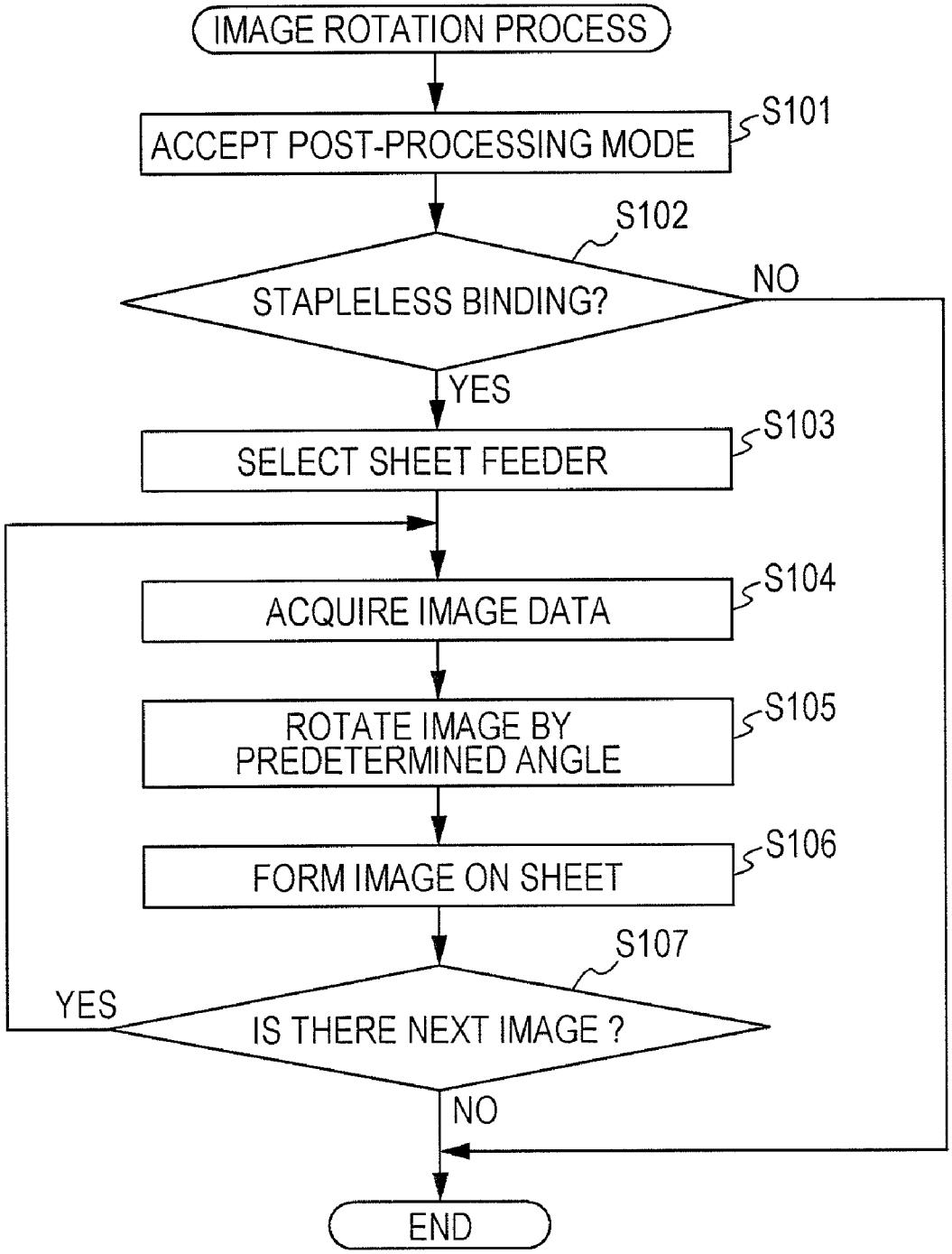
FIG. 8 is a flowchart illustrating an image rotation process performed by an image processor under the control of a controller of an image forming apparatus.

Accordingly, the controller 4 of the image forming apparatus 2 of the first exemplary embodiment commands the image processor 5 to perform an image rotation process in accordance with the post-processing mode selected by a user as described below. FIG. 8 is a flowchart illustrating the image rotation process performed by the image processor 5 under the control of the controller 4 of the image forming apparatus 2. First, the controller 4 accepts the post-processing mode (which of the staple binding process, the stapleless binding process, and both of these processes is/are to be performed or none of these processes is to be performed), which is selected by the user using the operation unit or the like (step S101).

If the accepted post-processing mode is the stapleless binding process (YES in step S102), the controller 4 selects the sheet feeder 6 (for example, one of the sheet feeders 6*a* and 6*b*) containing the sheet S on which an image is to be formed (step S103). In the first exemplary embodiment, the sheet feeder 6 that is the same as the case where a staple is used may be selected. The controller 4 acquires image data for forming the image, which has been read by the image reader (step S104), and commands the image processor 5 to rotate the image by a predetermined angle (step S105). In the first exemplary embodiment, the image is rotated by 180 degrees. This rotation may be performed by using an existing image processing technology. The controller 4 commands the image forming section 7 to form the rotated image on the sheet S (step S106). Subsequently, the controller 4 determines whether there is the next image data for forming an image (step S107). If there is the next image data, the process after step S104 is performed again. If there is not the next image data, the process ends. If the accepted post-processing mode is not a stapleless binding process (No in step S102), it is not necessary to perform the image rotation, and the process ends.

Figure 9:
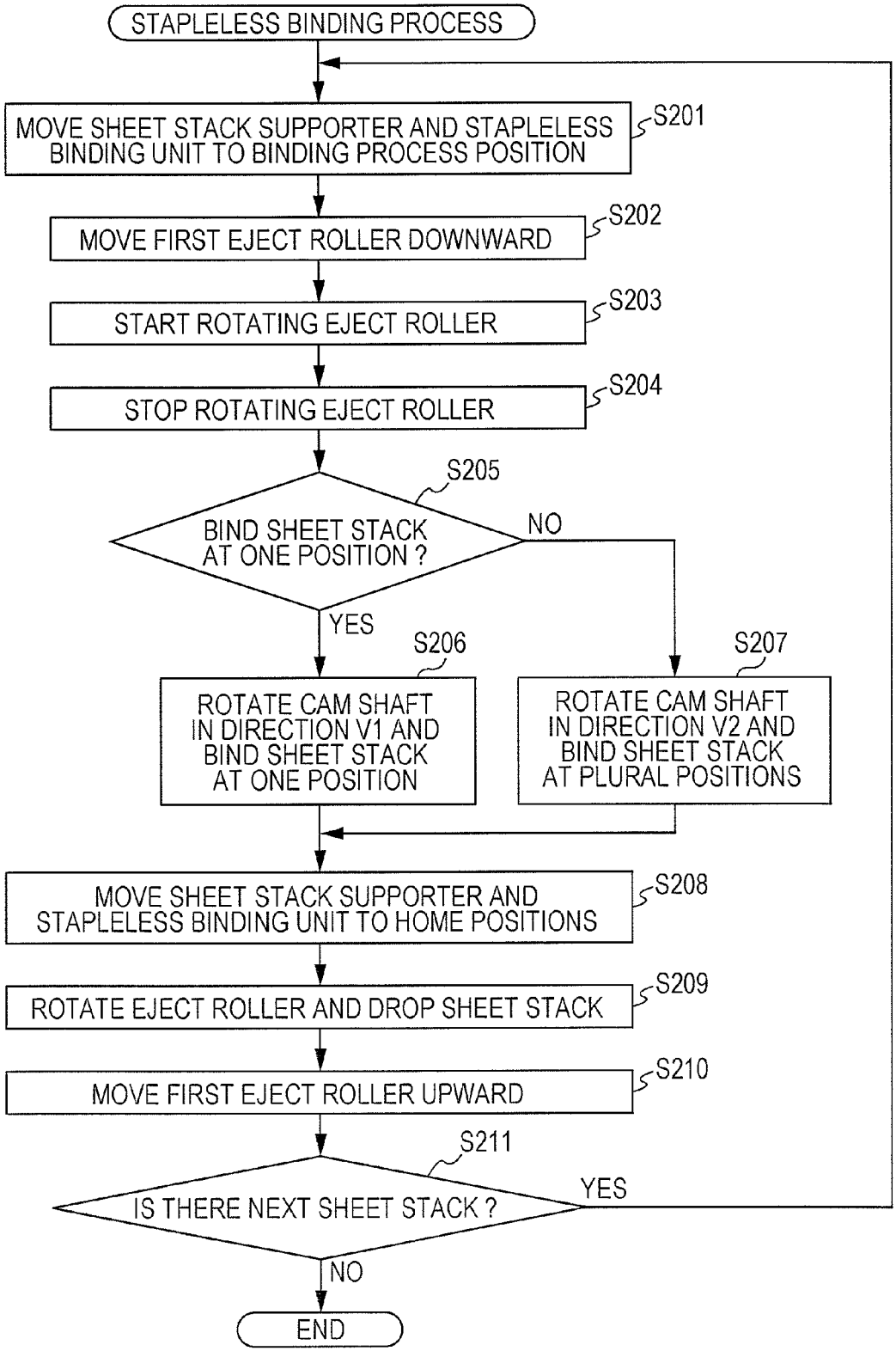
FIG. 9 is a flowchart illustrating a stapleless binding process performed under the control of a controller of a sheet handling apparatus.

Next, the stapleless binding process performed by the stapleless binding unit 60 will be described. FIG. 9 is a flowchart illustrating the stapleless binding process performed under the control of the controller 20. When the stapleless binding process starts, the controller 20 moves the sheet stack supporter 51 and the stapleless binding unit 60 to the binding process positions on the sheet transport path (in directions W2 and B2 in FIG. 4, respectively) (step S201). When the compile tray 35 has compiled the sheets into a sheet stack, the first eject roller 39*a* is moved downward (in the direction Q1 in FIG. 2) and made to contact the sheet stack (step S202). The eject roller 39 (including the first eject roller 39*a* and the second eject roller 39*b*) is rotated in the direction T1 in FIG. 2 (step S203). The sheet stack is transported to a space between the upper chute 61 and the lower chute 62 of the stapleless binding unit 60. When a part of the sheet stack to be bound reaches a predetermined binding position, the rotation of the eject roller 39 is stopped and the sheet stack is stopped (step S204).

The controller 20 determines whether one-position binding is selected as the post-processing mode (step S205). When performing one-position binding, as described above, the cam shaft 63 of the stapleless binding unit 60 rotates in the direction V1 in FIGS. 5B and 5C, and the stapleless binding mechanism 70*c* performs the one-position binding (step S206). If plural-position binding is selected as the post-processing mode, the cam shaft 63 of the stapleless binding unit 60 rotates in the direction V2 in FIGS. 5B and 5C, and the four stapleless binding mechanisms 70*a* to 70*d* perform the plural position-binding (step S207).

After the binding process has been finished, the controller 20 moves the sheet stack supporter 51 and the stapleless binding unit 60 from the binding process positions to the home positions (in directions W1 and B1 in FIG. 3, respectively) (step S208). At the same time, the eject roller 39 is rotated in the direction T1 in FIG. 2, whereby the sheet stack, on which the stapleless binding has been performed, is dropped and stacked on the stacker tray 80 (step S209). While the sheet stack is being transported by the eject roller 39, the first eject roller 39*a* is moved upward (step S210). Subsequently, the controller 20 determines whether there is the next sheet stack (step S211). If there is the next sheet stack, the process after step S201 is performed again. If there is not the next sheet stack, the process ends.

As described above, in the image forming system 1 according to the first exemplary embodiment, the stapleless binding unit 60 is disposed downstream of the eject roller 39, which serves as the transport unit, in the sheet transport path of the second post-processing device 50, and the stapleless binding process is performed so that the end portion of the sheet stack at the downstream end in the sheet transport direction is bound. Therefore, the stapleless binding unit 60 performs the stapleless binding process at a position downstream of the eject roller 39 in the transport direction in which the sheet stack is output to the outside of the sheet handling apparatus 3. Moreover, when performing the stapleless binding process, in order to match the binding position of the sheet stack with the orientation of the image formed on the sheet S, the controller 4 commands the image processor 5 to rotate the image to be formed on the sheet S by 180 degrees as compared with the case where the stapler 40 performs a binding process.

In the first exemplary embodiment, the stapleless binding unit 60 moves between the home position and the binding process position. However, the stapleless binding unit 60 may be fixed in the second post-processing device 50. In this case, when performing the stapleless binding process, the controller 20 moves the sheet stack supporter 51 to the position 51*b* in FIG. 4 on the sheet transport path, rotates the eject roller 39 in the direction T1 in FIG. 2, and inserts the sheet stack into the stapleless binding unit 60. After the stapleless binding process has been performed, the controller 20 rotates the eject roller 39 reversely in the direction T2 in FIG. 2, pulls back the sheet stack by a certain amount upstream in the sheet transport direction, and retracts the sheet stack supporter 51 from a position on the sheet transport path to the position 51*a* in FIG. 3. The, the controller 20 may rotate the eject roller 39 again in the direction T1 in FIG. 2 so as to output the sheet stack to the stacker tray 80.

In the first exemplary embodiment, either the stapler 40 or the stapleless binding unit 60 performs the binding process. However, both the stapler 40 and the stapleless binding unit 60 may be used to bind end portions of the sheet stack that are opposite each other. This binding process is appropriate, for example, when temporarily binding one end portion assuming that the end portion is opened afterward, such as the case when making an examination booklet, or when it is necessary to indicate that the sheet stack has not been opened.

Second Embodiment

Hereinafter, the image forming system 1 according to the second exemplary embodiment will be described. The functions the same as those of the first exemplary embodiment will be denoted by the same numerals, and the description thereof will be omitted. As with the first exemplary embodiment, the image forming system 1 according to the second exemplary embodiment includes the image forming apparatus 2 and the sheet handling apparatus 3. The sheet handling apparatus 3 includes the transport unit 10, the first post-processing device 30, and the second post-processing device 50. Except for the second post-processing device 50, the elements of the second exemplary embodiment is the same as those of the first exemplary embodiment, and detailed description of such elements will be omitted.

Figure 10:
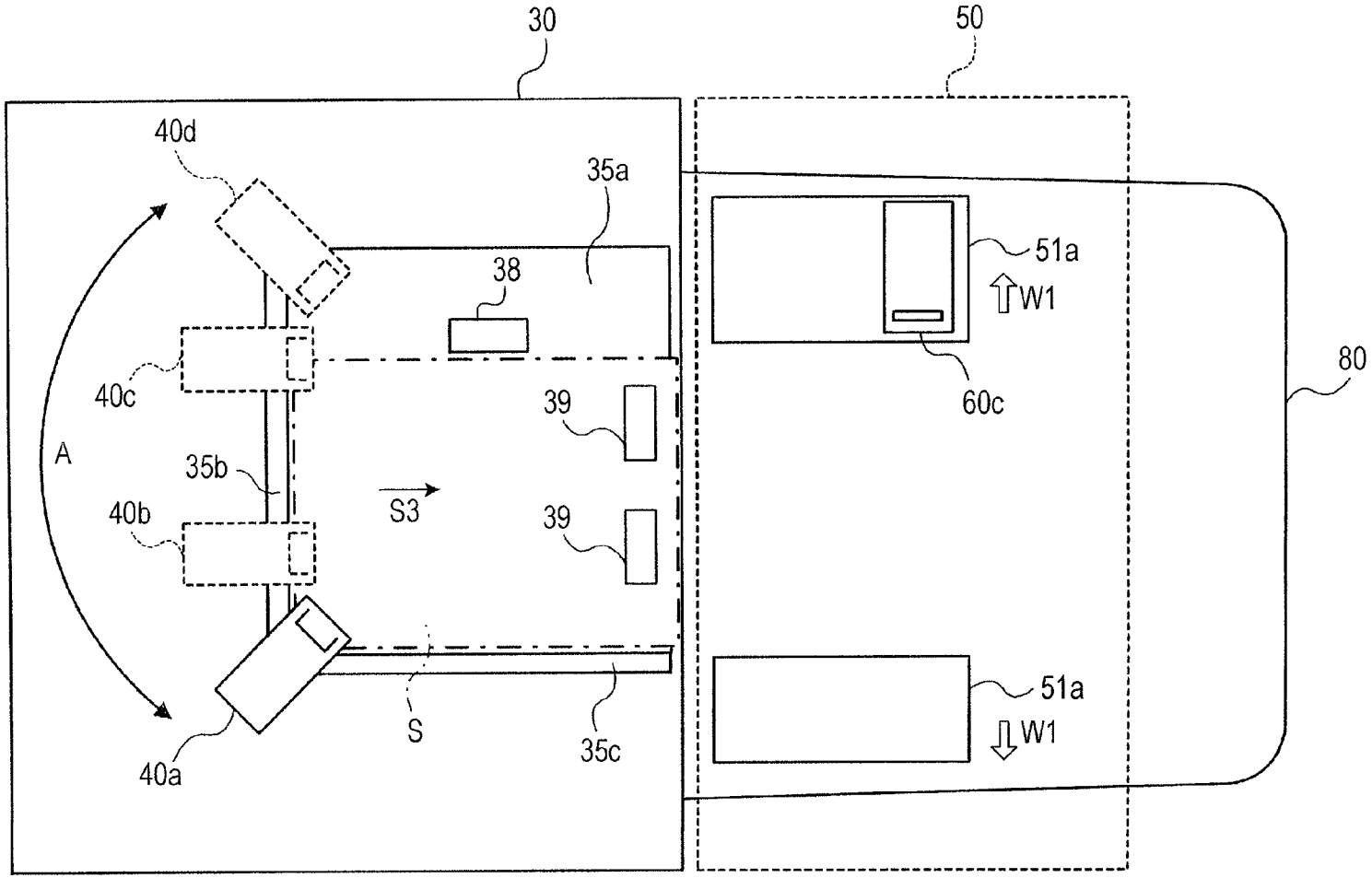
FIG. 10 is a top view of a first post-processing device and a second post-processing device according to a second exemplary embodiment, viewed from a direction substantially perpendicular to a surface of a sheet that is being transported.
Figure 11:
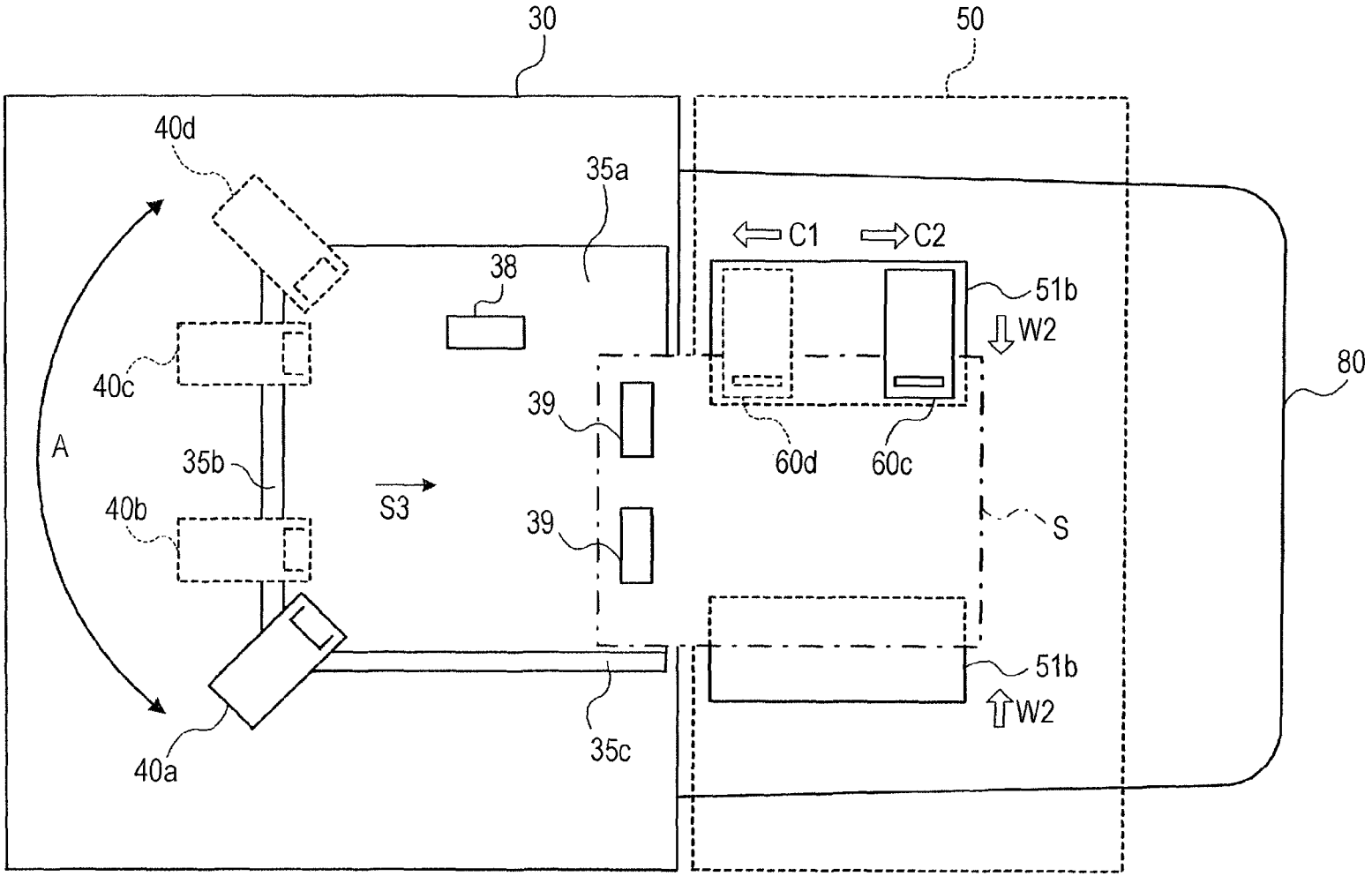
FIG. 11 is a top view similar to FIG. 10, illustrating a state in which the second post-processing device is performing a stapleless binding process.

In the second post-processing device 50 according to the second exemplary embodiment, the stapleless binding unit 60 is disposed at a position on a lateral side of the sheet transport path and on the distal side of the second post-processing device 50 of FIG. 1. The stapleless binding unit 60 performs stapleless binding on an end portion (second end portion) of the sheet stack that is parallel to the sheet transport direction. FIG. 10 is a top view of the first post-processing device 30 and the second post-processing device 50 according to the second exemplary embodiment, viewed from a direction substantially perpendicular to a surface of the sheet S that is being transported. FIG. 11 is a top view similar to FIG. 10, illustrating a state in which the second post-processing device 50 is performing a stapleless binding process. For simplicity, some members such as the main paddle 36 are not illustrated in FIGS. 10 and 11.

The sheet stack supporter 51 of the second post-processing device 50 supports the sheet stack when the stapleless binding unit 60 performs the stapleless binding process. The sheet stack supporter 51 has a surface that contacts the lowermost surface of the sheet stack that is being transported. The sheet stack supporter 51 is movable in directions (W1 and W2 in FIGS. 10 and 11) that are substantially perpendicular to (intersect) the sheet transport direction. When the stapleless binding unit 60 does not perform the stapleless binding process, the sheet stack supporter 51 is disposed at a home position (the position 51*a* in FIG. 10) that is outside the sheet transport path (i.e., outside the end portions of the sheet stack parallel to the sheet transport direction). When the stapleless binding unit 60 performs the stapleless binding process, the sheet stack supporter 51 moves from the home position to the stapleless binding position (the position 51*b* in FIG. 11) in which the sheet stack supporter 51 supports the sheet stack.

The stapleless binding unit 60 of the second post-processing device 50 includes a stapleless binding mechanism that performs binding on an end portion of the sheet stack that has been transported, the end portion being parallel to the sheet transport direction and passing a distal side (a side opposite the side on which the side guide 35*c* (see FIG. 10)) of the second post-processing device 50. The stapleless binding mechanism is similar to each of the stapleless binding mechanisms 70 described above with reference to FIGS. 5A to 5C. As illustrated in FIGS. 10 and 11, the stapleless binding unit 60 is disposed on the sheet stack supporter 51 that is on the distal side of the second post-processing device 50. The stapleless binding unit 60 is movable together with the sheet stack supporter 51 in a direction that intersects the sheet transport direction. The stapleless binding unit 60 includes a base (not shown), which supports the stapleless binding unit 60, and a rail (not shown), which is formed on the base and provides a path on which the stapleless binding unit 60 moves. The rail extends on the sheet stack supporter 51 in a direction substantially parallel to the sheet transport direction. The stapleless binding unit 60 is movable on the rail in directions C1 and C2 in FIG. 11.

When the stapleless binding process is not performed, the stapleless binding unit 60 is in the home position (the position 51*a* in FIG. 10) on the sheet stack supporter 51, in which the stapleless binding unit 60 does not obstruct the path of the sheet stack from moving toward the stacker tray 80. When the stapleless binding process is performed on the sheet stack that has been transported, the stapleless binding unit 60 and the sheet stack supporter 51 move in the direction W2 in FIG. 11, and successively performs the binding process in the binding process position (the position 51*b* in FIG. 11) on the sheet stack supporter 51. That is, the stapleless binding unit 60 moves on the rail disposed on the sheet stack supporter 51 in directions C1 and C2 in FIG. 11 in accordance with the post-processing mode (see positions 60*c* and 60*d* in FIG. 11), and performs one-position or plural-position stapleless binding on the sheet stack. The movements of the sheet stack supporter 51 and the stapleless binding unit 60 and the binding process performed by the stapleless binding unit 60 are controlled by the controller 20.

Next, the operation of the image forming system 1 according to the second exemplary embodiment will be described. When the binding process using the stapler 40 is selected as the post-processing mode, the operation is the same as that of the first exemplary embodiment. Therefore, a case where the stapleless binding process is selected as the post-processing mode will be described.

When a user operates the operation section or the like and selects a binding process using the stapleless binding unit 60 as the post-processing mode, the controller 20 of the sheet handling apparatus 3, upon receiving the selection, commands the stapleless binding unit 60 to perform the stapleless binding process, and moves the sheet stack supporter 51 and the stapleless binding unit 60 to the binding process positions. The controller 4 of the image forming apparatus 2 commands the image forming section 7 to perform the image forming process. The stapler 40 and the stapleless binding unit 60 are configured to bind the sheet stack at end portions that extend perpendicular to each other. Therefore, when the stapleless binding process is selected, the image forming section 7 forms an image, which is rotated by 90 degrees as compared with the case where the binding process using the stapler 40 is selected, on the sheet S (as will be described below).

Thus, after a toner image has been formed on the sheet S by the image forming section 7 and the toner image has been fixed by the fixing section 8, the sheet S is supplied to the sheet handling apparatus 3 one by one through the output rollers 9 of the image forming apparatus 2. In the sheet handling apparatus 3, after the sheet stack has been compiled on the compile tray 35 as described above, the first eject roller 39*a* moves downward (direction Q1 in FIG. 2). The first eject roller 39*a* and the second eject roller 39*b* rotate in the direction T1 in FIG. 2, so that the sheet stack is transported downstream in the direction S3 in FIG. 2 toward the stapleless binding unit 60.

When the stapleless binding process starts, the sheet stack supporter 51 moves from the home position in the second post-processing device 50 (the position 51*a* in FIG. 10) in the direction W2 to the binding process position (the position 51*b* in FIG. 11), where the sheet stack supporter 51 then stands by. The stapleless binding unit 60 and the sheet stack supporter 51 move to the binding process position, where the stapleless binding unit 60 and the sheet stack supporter 51 then stand by. The eject roller 39 transports the sheet stack into the second post-processing device 50. As described above, the eject roller 39 has a registration function of adjusting the position of the sheet stack by performing the stop/transport control of the sheet stack. Therefore, the sheet stack is transported to a predetermined position, and the sheet stack is inserted from a lateral side into a space between the upper chute 61 and the lower chute 62 (see FIGS. 5A to 5C) of the stapleless binding unit 60.

The sheet stack is stopped at a predetermined position, and the stapleless binding mechanism 70 performs the stapleless binding process. For example, if one-position binding is selected as the post-processing mode, the stapleless binding unit 60 remains in the position 60*c* in FIG. 11 and performs the binding process using the stapleless binding mechanism 70. If plural-position binding is selected as the post-processing mode, the stapleless binding unit 60 successively moves on the rail described above in a direction that is substantially parallel to the sheet transport direction (directions C1 and C2 in FIG. 11), and the stapleless binding mechanism 70 performs plural-position binding.

Subsequently, the sheet stack supporter 51 and the stapleless binding unit 60 move from the position 51*b* in FIG. 11 to the position 51*a* in FIG. 10 in the direction W1, and the sheet stack supporter 51 and the stapleless binding unit 60 retracts from the sheet transport path. The first eject roller 39*a* and the second eject roller 39*b* rotate in the direction T1 in FIG. 2. Thus, the sheet stack, on which the stapleless binding process has been performed, is dropped onto the stacker tray 80 and stacked.

Figure 12A:
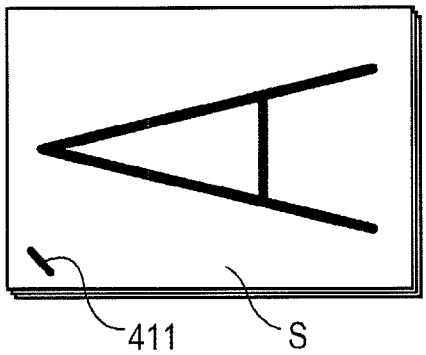
FIGS. 12A to 12D illustrate the relationship between the binding position of a sheet stack and the orientation of an image formed a sheet according to the second exemplary embodiment.
Figure 12B:
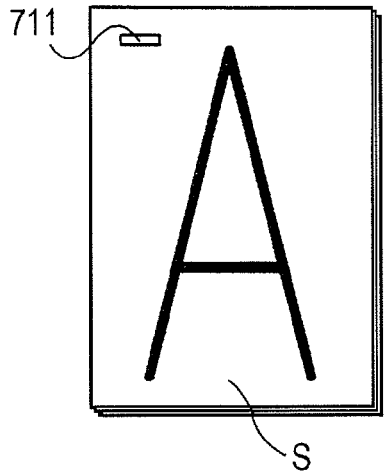

Next, a process of rotating an image formed on the sheet S, which is performed when the stapleless binding process is selected in the second exemplary embodiment, will be described. FIGS. 12A to 12D illustrate the relationship between the binding positions of the sheet stack and the orientation of an image formed on the sheet S according to the second exemplary embodiment. FIG. 12A illustrates a state in which a corner of a sheet stack of, for example, A4 short-edge feed sheets is bound by the stapler 40 with one staple 411. When binding one corner of the sheet stack by performing the stapleless binding process in a similar manner, because the end portion of the sheet stack bound by the stapler 40 and the end portion of the sheet stack bound by the stapleless binding unit 60 are perpendicular to each other (adjacent to each other), the embossed mark 711 is formed in an upper end portion of the sheet stack in FIG. 12B (an end portion that passes the distal side of the second post-processing device 50 in FIG. 11). Therefore, as illustrated in FIG. 12B, it is necessary to form an image on the sheet S so that the image is rotated clockwise by 90 degrees as compared with the case where the stapler 40 performs the binding process. Moreover, it is necessary to change the orientation of the sheet, on which the image is to be formed, from short-edge feed to long-edge feed.

Figure 12C:
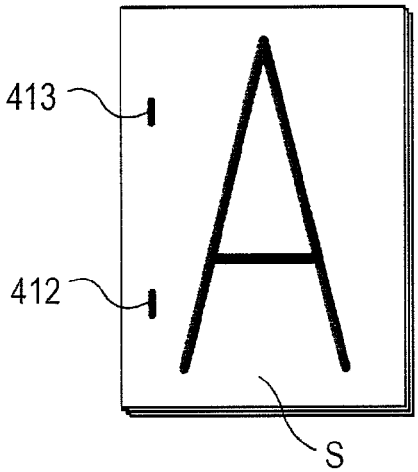
Figure 12D:
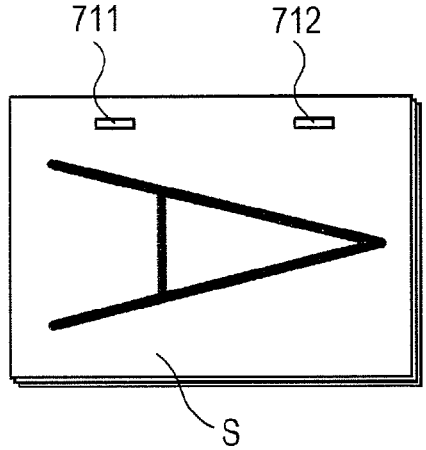

FIG. 12C illustrates a state in which an end portion of a sheet stack of, for example, A4 long-edge feed sheets is bound by the stapler 40 with two staples 412 and 413. When binding plural positions in an end portion of the sheet stack by performing the stapleless binding process, embossed marks 711 and 712 are formed at upper end portion of FIG. 12D as described above. Therefore, as illustrated in FIG. 12D, it is necessary to form an image on the sheet S so that the image is rotated clockwise by 90 degrees as compared with the case where the stapler 40 performs the binding process. Moreover, it is necessary to change the orientation of the sheet on which the image is to be formed from short-edge feed to long-edge feed.

Accordingly, the controller 4 of the image forming apparatus 2 of the second exemplary embodiment commands the image processor 5 to perform an image rotation process in accordance with the post-processing mode selected by a user.

The controller 4 commands the image rotation process the same as that of the first exemplary embodiment illustrated in FIG. 8 except for the following steps. In the second exemplary embodiment, in step S103, the controller 4 selects the sheet feeder 6 that is different from the sheet feeder 6 that is used when the binding process using a staple is performed. That is, for example, if the sheet feeder 6*a* for A4 short-edge feed sheets has been preselected, the controller 4 selects the sheet feeder 6*b* for A4 long-edge feed sheets. On the contrary, if the sheet feeder 6*b* has been preselected, the controller 4 selects the sheet feeder 6*a*. In step S105, the controller 4 commands the image processor 5 to rotate the acquired image clockwise by 90 degrees.

In the second exemplary embodiment, the stapleless binding process performed under the control of the controller 20 is the same as that of the first exemplary embodiment illustrated in FIG. 9 except for the following steps. In steps S206 and S207, instead of changing the rotation direction of the cam shaft 63 depending on whether the binding is performed at one position or plural positions, according to the second exemplary embodiment, the operations that the stapleless binding unit 60 moves to a predetermined position (such as the position 60*c* or 60*d* in FIG. 11) and performs the binding process is repeated for the number of binding positions that have been specified.

As described above, in the image forming system 1 according to the second exemplary embodiment, the stapleless binding unit 60 is disposed downstream of the eject roller 39, which serves as the transport unit, and on a lateral side of the sheet transport path of the second post-processing device 50, and the stapleless binding process is performed so as to bind an end portion of the sheet stack that is parallel to the sheet transport direction. Therefore, the stapleless binding unit 60 performs the stapleless binding process at a position downstream of the eject roller 39 in the transport direction in which the sheet stack is output to the outside of the sheet handling apparatus 3. Moreover, when performing the stapleless binding process, in order to match the binding position of the sheet stack with the orientation of the image formed on the sheet S, the controller 4 commands the image processor 5 to rotate the image to be formed on the sheet S clockwise by 90 degrees as compared with the case where the stapler 40 performs a binding process.

In the second exemplary embodiment, the stapleless binding unit 60 is movable together with the sheet stack supporter 51 in directions substantially perpendicular to the sheet transport direction (directions W1 and W2 in FIGS. 10 and 11). However, the stapleless binding unit 60 and the sheet stack supporter 51 may move independently.

In the second post-processing device 50 of the second exemplary embodiment, the stapleless binding unit 60 is disposed on a lateral side of the sheet transport path and on the distal side of the second post-processing device 50 in FIG. 10. However, the stapleless binding unit 60 may be disposed on the proximal side of the second post-processing device 50 (i.e., on a side on which the side guide 35*c* is disposed). In this case, when performing the stapleless binding process, in order to match the binding position of the sheet stack with the orientation of the image formed on the sheet S, it is necessary for the controller 4 to command the image processor 5 to rotate the image to be formed on the sheet S counterclockwise by 90 degrees as compared with the case where the stapler 40 performs a binding process.

Figure 13A:
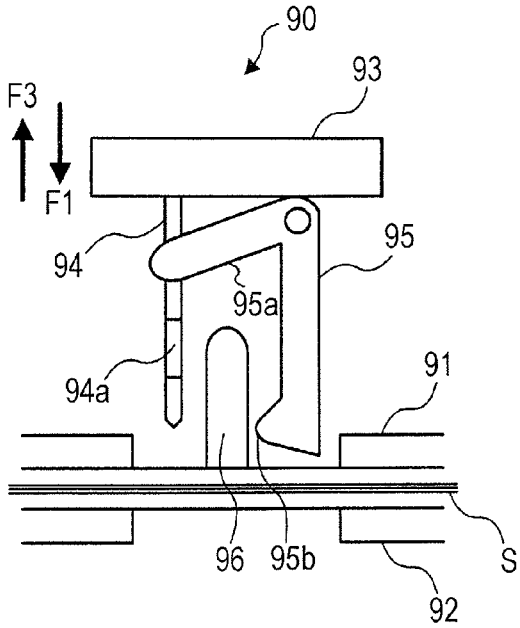
FIGS. 13A to 13D illustrate another example of a stapleless binding unit and a sheet stack on which a stapleless binding process has been performed.

Alternatively, the stapleless binding unit 60 may be configured as follows. FIGS. 13A to 13D illustrate the structure of a stapleless binding unit 90 and a sheet stack on which stapleless binding has been performed. As illustrated in FIG. 13A, the stapleless binding unit 90 depresses a base member 93 in a direction F1 while sandwiching the sheet stack between a base portion 91 and a bottom portion 92, thereby binding the sheet stack as described below.

Figure 13B:
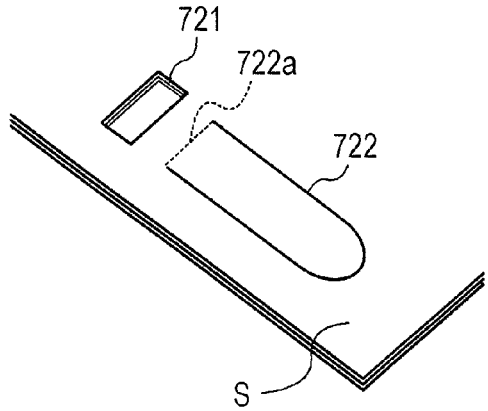
Figure 13C:
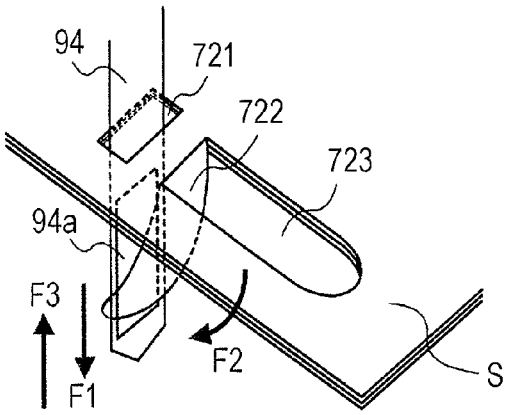
Figure 13D:
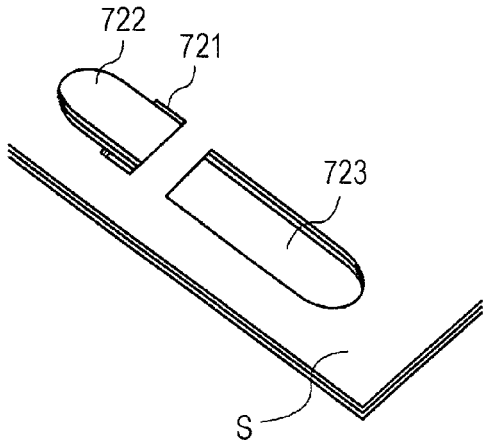

First, a blade 94 and a punching member 95 penetrate the sheet stack (stack of the sheets S). As illustrated in FIG. 13B, a slit 721 and a tongue-like portion 722, in which the sheet stack is punched except for an end portion 722*a*, are formed in the sheet stack. When the base member 93 is further depressed, an upper end portion 95*a* of the punching member 95 contacts a protruding member 96 that is integrally formed with the base portion 91, and the punching member 95 rotates clockwise in FIG. 13A. Thus, as illustrated in FIG. 13C, a projection 95*b* at the tip of the punching member 95 pushes the tongue-like portion 722 in a direction F2 in FIG. 13C toward an eyelet 94*a* formed in the blade 94. The punching member 95 is not illustrated in FIG. 13C. When the base member 93 is moved upward in a direction F3 in FIG. 13C in this state, the blade 94 moves upward while the tongue-like portion 722 is hooked in the eyelet 94*a* of the blade 94. As illustrated in FIG. 13D, the tongue-like portion 722 is inserted into the slit 721, and the sheet stack is bound. At this time, a binding hole 723 is formed in the sheet stack at a position punched by the tongue-like portion 722.

In the above description, the stapler 40 is used as an example of the first binding unit, and the stapleless binding units 60 and 90 are used as examples of the second binding unit. However, the first and second binding units are not limited thereto. For example, the first and second binding units may be of the same type. That is, the first binding unit may be a binding unit using a first staple, and the second binding unit may be a binding unit using a second staple that may be removed with a force smaller that that of removing the first staple. The second binding unit may be different from the stapleless binding mechanism 70, and may be a binding unit using an adhesive or the like.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming system comprising:

an image forming unit that forms images on sheets;

a sheet compiling unit that compiles the sheets on which the image forming unit has formed the images into a sheet stack;

a first binding unit that binds a first end portion of the sheet stack by performing a first binding process, the sheet stack having been compiled by the sheet compiling unit;

a second binding unit that binds a second end portion of the sheet stack by performing a second binding process, the sheet stack having been compiled by the sheet compiling unit, the second end portion being different from the first end portion; and an image rotation unit that rotates an orientation of each of the images in accordance with whether the sheet stack is to be bound by using the first binding unit or the second binding unit, the images being formed on the sheets of the sheet stack by the image forming unit.

2. The image forming system according to claim 1, wherein the second end portion of the sheet stack is opposite the first end portion of the sheet stack, and wherein, when the second binding process is performed, the image rotation unit rotates the orientation of each of the images by 180 degrees as compared with a case where the first binding process is performed, the images being formed on the sheets of the sheet stack by the image forming unit.

3. The image forming system according to claim 2, wherein the second binding unit is disposed downstream of the sheet compiling unit in a transport direction of the sheet stack, and the second binding unit is configured to be movable back and forth in the transport direction and/or in directions that intersect the transport direction.

4. The image forming system according to claim 1, wherein the second end portion of the sheet stack is adjacent to the first end portion of the sheet stack, and wherein, when the second binding process is performed, the image rotation unit rotates the orientation of each of the images by 90 degrees as compared with a case where the first binding process is performed, the images being formed on the sheets of the sheet stack by the image forming unit.

5. The image forming system according to claim 4, wherein the second binding unit is disposed on a lateral side of the sheet stack with respect to a transport direction of the sheet stack, and the second binding unit is configured to be movable back and forth in directions that intersect the transport direction.

6. The image forming system according to claim 1, further comprising:

a sheet stack tray on which the sheet stack that is output from a device body is stacked, wherein the second binding unit is disposed above the sheet stack tray.

7. The image forming system according to claim 6, further comprising:

a transport unit that transports the sheet stack from the sheet compiling unit toward the second binding unit or toward the sheet stack tray; and a support unit that supports the sheet stack at a position between end portions of the sheet stack that is transported by the transport unit toward the second binding unit when the second binding process is performed, wherein, after the second binding process has been performed, the support unit moves to a position outside the end portions of the sheet stack and drops the sheet stack onto the sheet stack tray.

8. The image forming system according to claim 7, wherein, when the second binding process is performed, the transport unit transports the sheet stack downstream in an output direction, the output direction being a transport direction in which the sheet stack is output, and after the second binding process has been performed, the transport unit pulls back the sheet stack upstream with respect to the output direction by a predetermined distance and transports the sheet stack again downstream toward the sheet stack tray.

9. The image forming system according to claim 1, wherein the first binding unit performs the first binding process by penetrating a staple into the sheet stack, and wherein the second binding unit performs the second binding process by forming protrusions and recesses that extend in a stacking direction of the sheets of the sheet stack.

10. A sheet handling apparatus comprising:

a sheet compiling unit that compiles sheets into a sheet stack, the sheets being supplied from an image forming apparatus that forms images on the sheets, the images being oriented in a first image orientation or in a second image orientation that is rotated by a predetermined angle with respect to the first image orientation;

a first binding unit that binds a first end portion of the sheet stack by performing a first binding process, the sheet stack having been compiled by the sheet compiling unit and including sheets on which images have been formed in the first image orientation; and a second binding unit that binds a second end portion of the sheet stack by performing a second binding process, the sheet stack having been compiled by the sheet compiling unit and including sheets on which images have been formed in the second image orientation, the second end portion being different from the first end portion.

* * * * *